US008819884B1

(12) United States Patent
Benline, Jr.

(10) Patent No.: US 8,819,884 B1
(45) Date of Patent: Sep. 2, 2014

(54) PAINT PAD WITH FLAT HANDLE

(71) Applicant: Harold W. Benline, Jr., Uhrichsville, OH (US)

(72) Inventor: Harold W. Benline, Jr., Uhrichsville, OH (US)

( * ) Notice: Subject to any disclaimer, the term of this patent is extended or adjusted under 35 U.S.C. 154(b) by 0 days.

(21) Appl. No.: 13/913,880

(22) Filed: Jun. 10, 2013

(51) Int. Cl.
*B05C 17/00* (2006.01)

(52) U.S. Cl.
CPC ..... *B05C 17/00* (2013.01)
USPC ..... 15/210.1; 15/144.3; 15/209.1

(58) Field of Classification Search
USPC ..... 15/209.1, 210.1, 244.1, 144.3
See application file for complete search history.

(56) References Cited

U.S. PATENT DOCUMENTS

| | | | | |
|---|---|---|---|---|
| 3,054,127 | A * | 9/1962 | Petsch et al. | 15/244.1 |
| 4,658,461 | A | 4/1987 | Roe et al. | |
| 4,926,522 | A | 5/1990 | Wang | |
| 5,556,470 | A | 9/1996 | Gruber | |
| 6,530,107 | B2 | 3/2003 | Kim | |
| 2005/0118345 | A1 * | 6/2005 | Burghoffer | 427/429 |

* cited by examiner

*Primary Examiner* — Randall Chin
(74) *Attorney, Agent, or Firm* — Crossley Patent Law; Micah C. Gunn

(57) ABSTRACT

A paint pad with flat handle including a parallelepiped head member having a first surface to which a paint pad releasably secures, said head member attached to a flat handle at a torsion spring pivot disposed upon a second surface of said head member, whereby the paint pad with flat handle has a low profile and is readily positional in tight and hard to reach spaces for application of paint thereat.

5 Claims, 4 Drawing Sheets

PAINT PAD WITH FLAT HANDLE

BACKGROUND OF THE INVENTION

Various types of painting application devices are known in the prior art. However, what is needed is a paint pad with flat handle that includes a parallelepiped head member having a first surface to which a paint pad releasably secures when engaged by a perimetric rim disposed around three sides of said first surface, said head member attached to a flat handle at a torsion spring pivot disposed upon a second surface of said head member, whereby the paint pad with flat handle has a short cross section and is readily positional in tight and hard to reach spaces for application of paint thereat.

FIELD OF THE INVENTION

The present invention relates to a paint pad with flat handle, and more particularly, to a paint pad with flat handle that includes a parallelepiped head member having a first surface to which a paint pad releasably secures when engaged by a perimetric rim disposed around three sides of said first surface, said head member attached to a flat handle at a torsion spring pivot disposed upon a second surface of said head member, whereby the paint pad with flat handle has a short cross section and is readily positional in tight and hard to reach spaces for application of paint thereat.

SUMMARY OF THE INVENTION

The general purpose of the paint pad with flat handle, described subsequently in greater detail, is to provide a paint pad with flat handle which has many novel features that result in a paint pad with flat handle which is not anticipated, rendered obvious, suggested, or even implied by prior art, either alone or in combination thereof.

It is often hard to paint behind large fixtures without moving said fixtures to gain access to tight and hard to reach spaces. However, some people are unable to move such fixtures, and some such fixtures are immovable, whereby a paint pad with flat handle is warranted for garnering access to paint such hard to reach and tight spaces.

The present paint pad with flat handle includes a parallelepiped head member having a first surface and a second surface. A perimetric rim is disposed upon three sides of the head member perpendicular said first and second surfaces. The perimetric rim is disposed to overhang the first surface and create a three-sided channel upon the perimeter of the head member into which channel a paint pad may releasably insert.

The head member also includes a pad attachment tab which releasably connects to the paint pad when inserted into the channel and releasably secured to the head member first surface. The paint pad is configured to overlie the first surface of the head member.

A torsion spring pivot is disposed on the second surface of the head member. The torsion spring pivot connects a first end of a flat handle to the second surface of the head member, and forces the head member into a plane parallel with said flat handle when pressure upon the head member is alleviated. The torsion spring pivot thus enables movement of the handle relative the head member during use of the paint pad with flat handle, and restores the position of the head member parallel the flat handle when such movement ceases and pressure upon the head member is removed.

The handle includes a second end whereat an aperture is disposed. The aperture is disposed endwise in the handle second end and is configured for interconnection with a forward tab disposed upon a handle extension. Thus, when said forward tab is inserted into the aperture, the handle extension is releasably secured to the handle second end, and the effective reach of the device into tight and hard to reach spaces is extended.

In use, a person attaches the paint pad to the first surface of the head member by sliding the pad into engagement with the perimetric rim. The pad attachment tab further stabilizes the paint pad in position upon the first surface of the head member. The paint pad is then dipped into a ready supply of paint. Because the head member is flattened, having a cross section small relative the length of the device, and because the handle (and any extensions there attached) are flat, the device is readily and expediently positional within tight spaces, such as behind a refrigerator, for example, or around a water heater in a cupboard, for example, or under a bath, say. Paint is thus readily applied from the pad to the relevant section of wall, floor, or ceiling, as case may be, without the user having to move said fixture out of the way to gain access to said section of wall, floor, or ceiling. The present paint pad with flat handle thus renders expedient an otherwise difficult and time consuming task.

Thus has been broadly outlined the more important features of the present paint pad with flat handle so that the detailed description thereof that follows may be better understood and in order that the present contribution to the art may be better appreciated.

Objects of the present paint pad with flat handle, along with various novel features that characterize the invention are particularly pointed out in the claims forming a part of this disclosure. For better understanding of the paint pad with flat handle, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
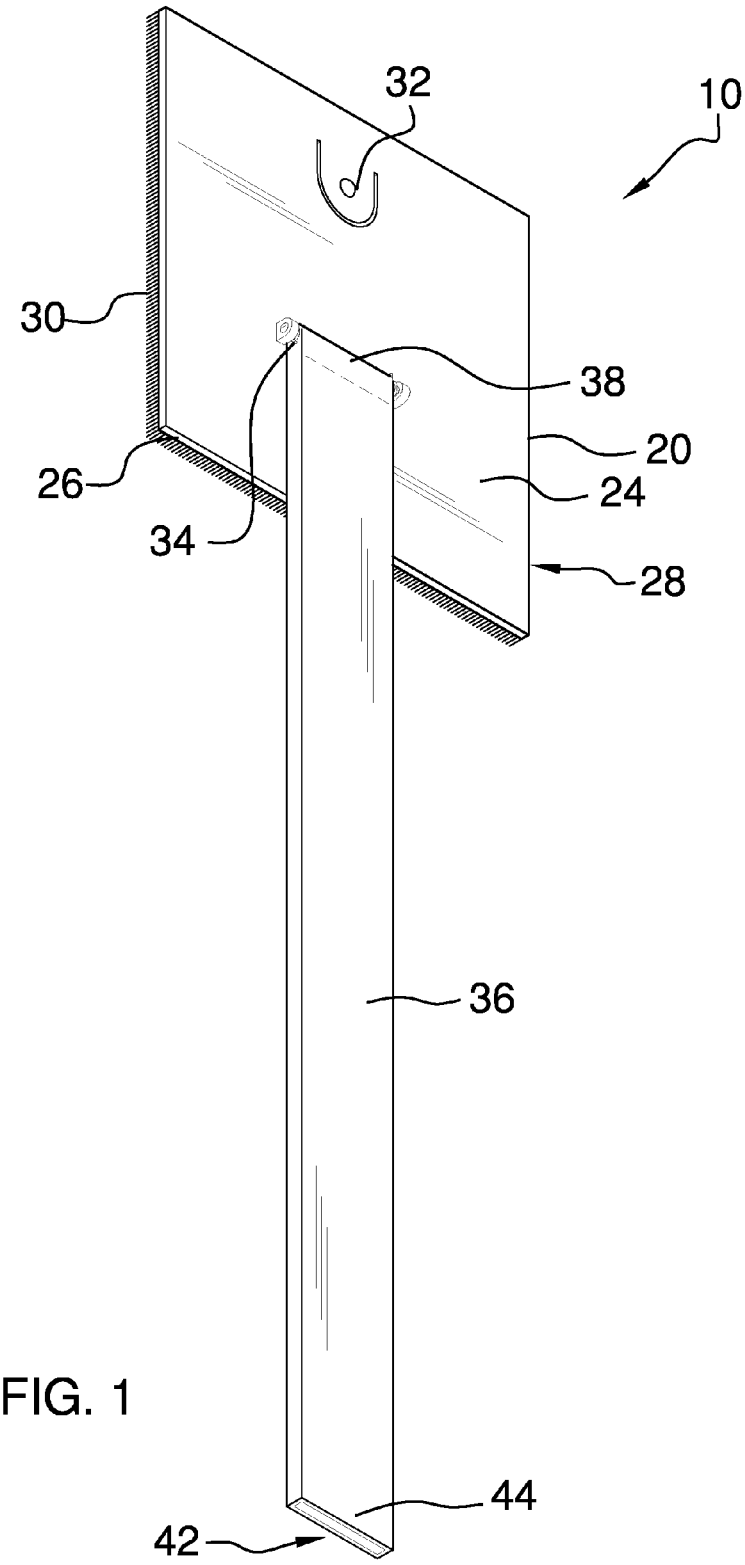
FIG. 1 is an isometric view.
Figure 2:
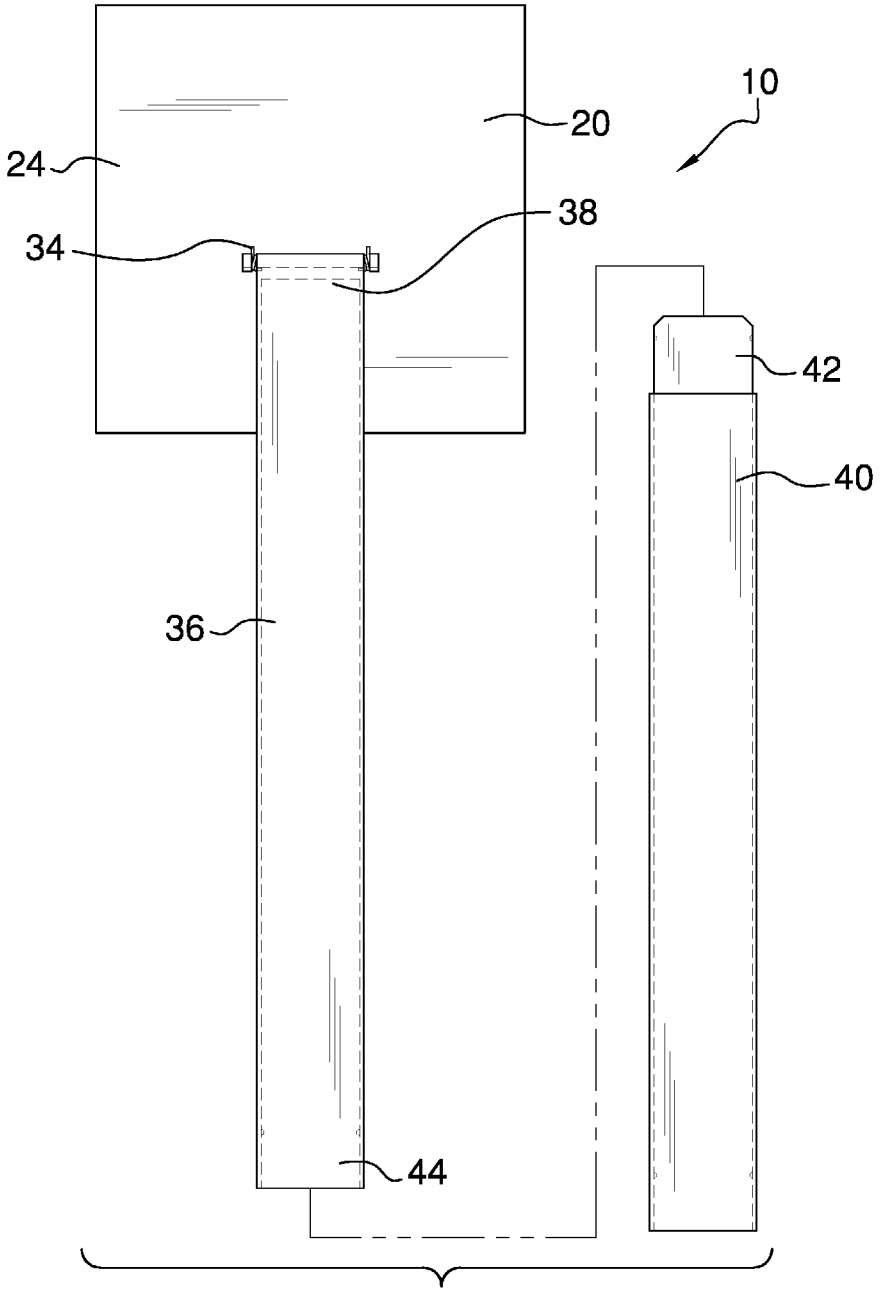
FIG. 2 is a rear view.
Figure 3:
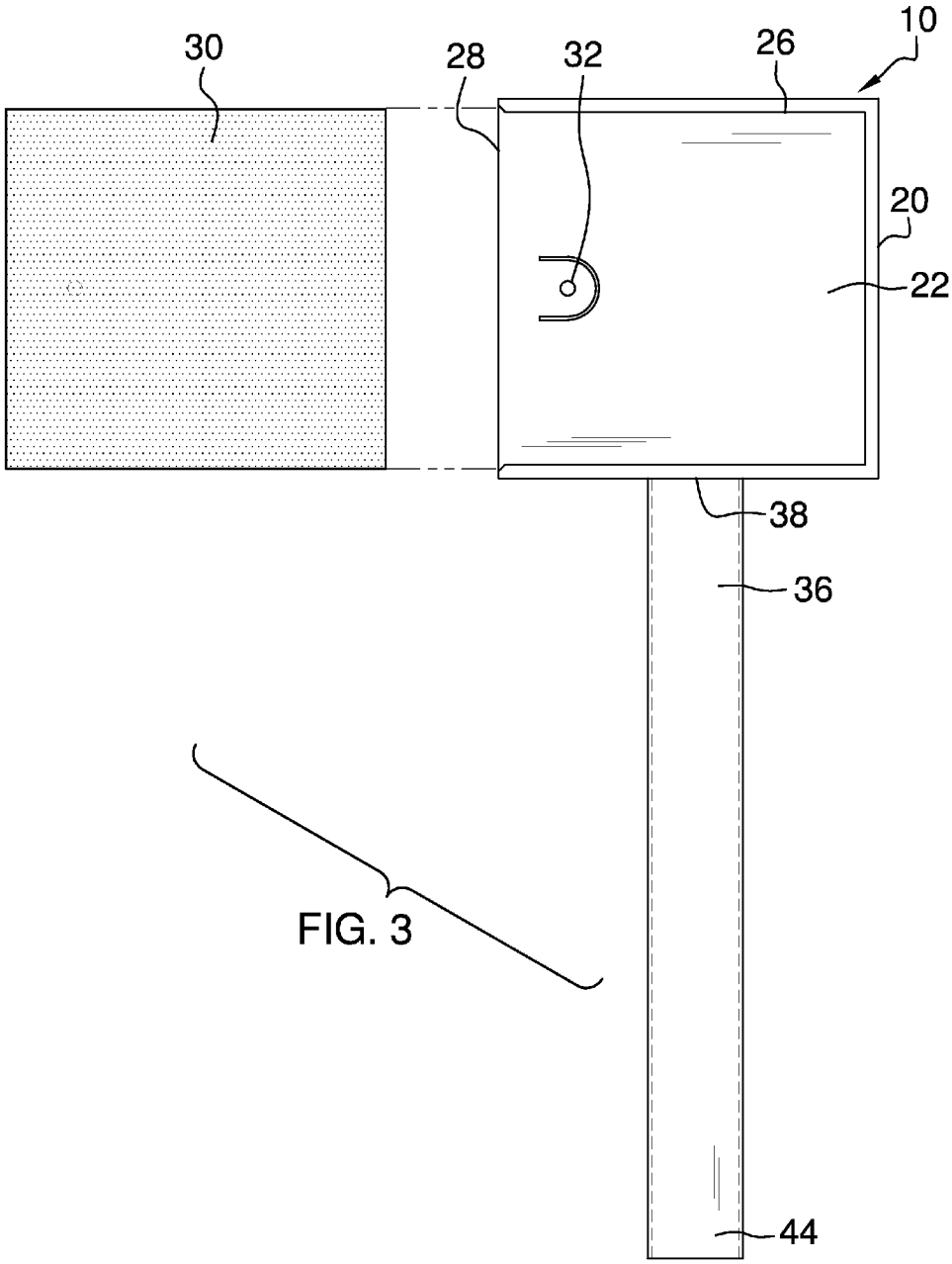
FIG. 3 is a front view.
Figure 4:
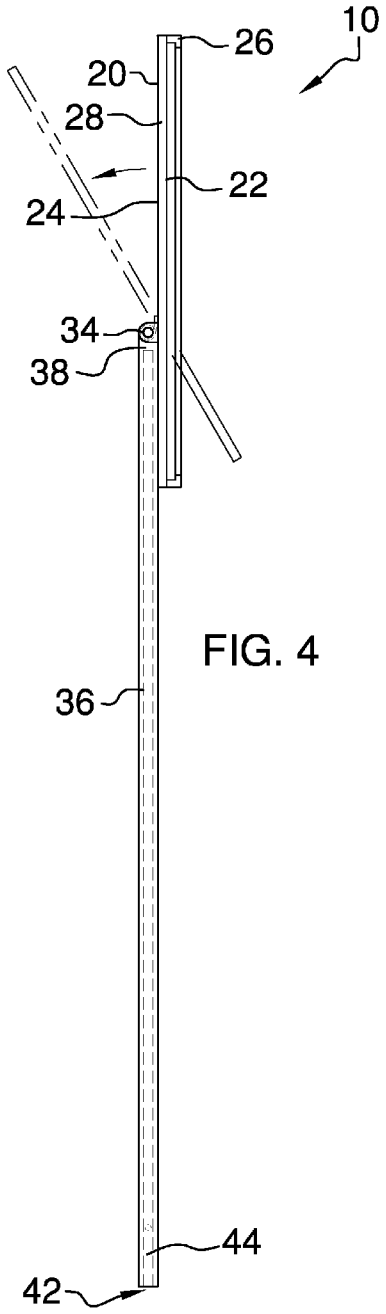
FIG. 4 is a side view.
Figure 5:
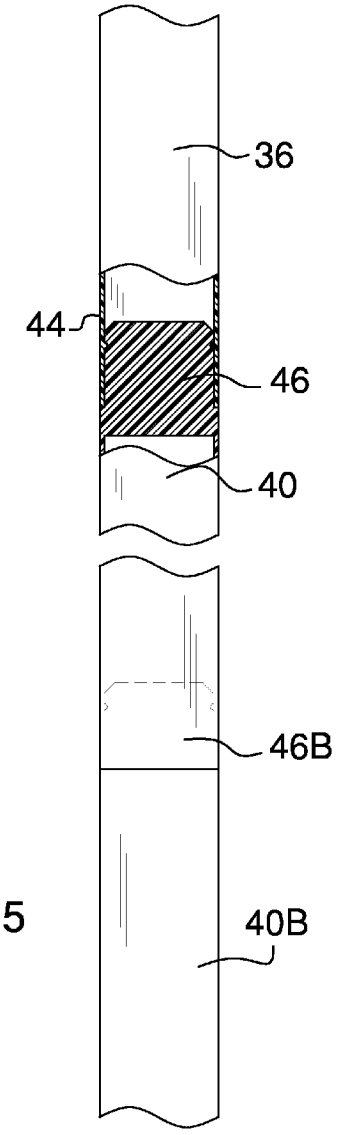
FIG. 5 is a detail view of a handle extension member releasably fastening to a second end of a flat, parallelepiped handle.

With reference now to the drawings, and in particular FIGS. 1 through 5 thereof, example of the instant paint pad with flat handle employing the principles and concepts of the present paint pad with flat handle and generally designated by the reference number 10 will be described.

Referring to FIGS. 1 through 5 a preferred embodiment of the present paint pad with flat handle 10 is illustrated.

The present paint pad with flat handle 10 has been devised to enable painting in tight spaces where a brush, roller, or other implement used in applying paint, presents a cross section too large to be effectively wielded therein. The present paint pad with flat handle 10, therefore, presents a low profile and is readily wielded in tight spaces where other painting implements cannot reach. Further, the present paint pad with flat handle 10 provides for extension into such places, where necessary, by the attachment of at least one handle extension 40, as will be described subsequently.

The paint pad with flat handle 10, therefore, includes a parallelepiped head member 20. The head member 20 includes a first surface 22 and a second surface 24. A perimetric rim 26 is disposed upon the head member 20 on three sides of said head member 20, said perimetric rim 26 disposed to overhang the first surface 22. A fourth, rimless side 28 thus remains for passage of a parallelepiped paint pad 30 for engagement with the perimetric rim 26, as will be described subsequently.

The parallelepiped paint pad 30 is releasably securable to the head member 20 first surface 22. The paint pad 30 slidably engages into the perimetric rim 26 on three sides of the head member 20 when attached to the first surface 22. For further stability, a pad attachment tab 32 is disposed upon the head member 20 first surface 22 more proximal the rimless side 28, to which attachment tab 32 the paint pad 30 releasably secures when slid into the perimetric rim 26 and secured to the head member 20 first surface 22.

A torsion spring pivot 34 is disposed upon the head member 20 second surface 24 for interconnection with a flat, parallelepiped handle 36. The handle 36 is attached to the torsion spring pivot 34 at a first end 38 of the handle 36. The torsion spring pivot 34 thus enables movement of the head member 20 relative the handle 36, while forcing the head member 20 back into a plane parallel with the handle 36 when said head member 20 is released from such movement.

At least one handle extension 40 is releasably securable into an aperture 42 disposed endwise at a second end 44 of the handle 36. The at least one handle extension 40 includes a forward tab 46 disposed to releasably snap into the aperture 42 disposed at the handle 36 second end 44. Said handle extension 40 may also include an aperture for interconnection with additional forward tabs 46B of additional handle extensions 40B, as desired (see FIG. 5).

Thusly, the paint pad with flat handle 10 has a low profile and is readily positional when painting in tight spaces.

What is claimed is:

1. A paint pad with flat handle comprising:

a parallelepiped head member having a first surface and a second surface;

a parallelepiped paint pad releasably securable to the head member first surface;

a torsion spring pivot disposed upon the head member second surface; and a flat, parallelepiped handle attached at a first end to the torsion spring pivot;

wherein the paint pad with flat handle has a low profile readily positional when painting in tight spaces;

a perimetric rim disposed upon three sides of the head member, said perimetric rim disposed to overhang the first surface, wherein the paint pad slidably inserts into said perimetric rim when attached to the head member first surface.

2. The paint pad with flat handle of claim 1 further comprising a pad attachment tab disposed upon the head member, said pad attachment tab disposed to further stabilize the paint pad to the first surface of the head member.

3. The paint pad with flat handle of claim 2 further comprising at least one handle extension, said handle extension releasably securable to the flat, parallelepiped handle at a second end.

4. The paint pad with flat handle of claim 3 wherein the at least one handle extension releasably clips into an aperture disposed at the handle second end.

5. A paint pad with flat handle comprising:

a parallelepiped head member having a first surface and a second surface;

a perimetric rim disposed upon the head member on three sides of said head member, said perimetric rim disposed to overhang the first surface;

a pad attachment tab disposed upon the head member first surface;

a parallelepiped paint pad releasably securable to the head member first surface, said paint pad slidably engaged by the perimetric rim and the attachment tab when attached to the head member;

a torsion spring pivot disposed upon the head member second surface;

a flat, parallelepiped handle attached at a first end to the torsion spring pivot;

an aperture disposed at a second end of the handle; and at least one handle extension releasably securable into the aperture at the handle second end;

wherein the paint pad with flat handle has a low profile readily positional when painting in tight spaces.

* * * * *